US007147197B2

(12) United States Patent
Dalton

(10) Patent No.: US 7,147,197 B2
(45) Date of Patent: Dec. 12, 2006

(54) CONCRETE HOME BUILDING

(75) Inventor: Michael E. Dalton, 9054 Parkhill Rd., Lenexa, KS (US) 66215

(73) Assignee: Michael E. Dalton, Overland Park, KS (US)

( * ) Notice: Subject to any disclaimer, the term of this patent is extended or adjusted under 35 U.S.C. 154(b) by 275 days.

(21) Appl. No.: 10/267,609

(22) Filed: Oct. 9, 2002

(65) Prior Publication Data

US 2004/0068945 A1 Apr. 15, 2004

(51) Int. Cl.
*E04G 13/04* (2006.01)

(52) U.S. Cl. ..... 249/25; 52/223.9; 52/262; 52/252; 52/724.1

(58) Field of Classification Search ..... 52/250, 52/223.8, 601, 223.1, 223.6, 726.1, 747.12, 52/284, 274, 745.05, 223.9, 223.11, 236.7, 52/236.9, 252, 258, 262; 249/724.1, 13, 249/18, 28, 188, 189, 25, 23, 19, 24
See application file for complete search history.

(56) References Cited

U.S. PATENT DOCUMENTS 2,435,998 A * 2/1948 Cueni ..... 52/223.8
2,925,727 A * 2/1960 Harris et al. ..... 52/745.05
3,349,527 A * 10/1967 Bruns ..... 52/169.9
3,890,750 A * 6/1975 Berman et al. ..... 52/127.3
3,900,182 A * 8/1975 Berman et al. ..... 249/24
3,993,282 A * 11/1976 Berman et al. ..... 249/24
4,041,664 A * 8/1977 Davis, Jr. ..... 52/223.8
4,344,262 A * 8/1982 Berman et al. ..... 52/223.12
4,509,305 A * 4/1985 Guinard ..... 52/223.11
5,655,243 A * 8/1997 Kim ..... 14/74.5
5,671,573 A * 9/1997 Tadros et al. ..... 52/223.8
5,671,582 A * 9/1997 Reay ..... 52/745.05
5,765,333 A * 6/1998 Cunningham ..... 52/481.1
5,987,827 A * 11/1999 Lord ..... 52/274
6,036,906 A * 3/2000 Tadros et al. ..... 264/228
6,345,403 B1 * 2/2002 Nagle ..... 14/77.1
6,374,556 B1 * 4/2002 Crant et al. ..... 52/182

* cited by examiner

*Primary Examiner*—Naoko Slack
*Assistant Examiner*—Jessica Laux
(74) *Attorney, Agent, or Firm*—Mark Manley

(57) ABSTRACT

A system of building concrete homes and apartment buildings. The system creates a structure that is well insulated and that is very practical and economical to build. The system uses standard components such as wall ties, concrete forms, rigid foam insulation, and concrete, all of which are readily available in the market today. The system creates a building that is insulated and thermally broken at its structural connections such that use in temperate and colder climates is possible. Presently concrete construction finds only limited use for the construction of single family and multi-family housing. The system is economical to construct when compared to wood frame housing.

8 Claims, 12 Drawing Sheets

CONCRETE HOME BUILDING

BACKGROUND OF THE INVENTION

In the concrete housing industry it is common to build multi-unit apartments and homes in warmer environments. But current concrete construction techniques have made concrete built homes more difficult to market in colder areas. It is common practice to use rigid foam insulation to improve the thermal performance of concrete homes and apartments. In some cases the foam is added to the concrete wall after it is cast, but it is also common to use the foam as part of the form when the concrete is cast and to leave the foam in place after the concrete is cast. But current concrete construction techniques lead to homes and apartments that have substantial thermal leaks built in.

A number of variations have been tried to effectively insulate a concrete building for cold areas. These attempts have so far failed to result in a marketable system. Often the proposed solutions have not been practical or cost effective, producing a building system that either requires a premium price on the market, or a building that is in-efficient to operate, or that requires a major change in the concrete industry and its current construction techniques.

In addition to energy issues, the costs associated with building concrete housing have been somewhat higher then the comparable housing built from wood framing. The construction industry is very sensitive to price and the cost differential has limited the market for concrete housing.

SUMMARY OF THE INVENTION

The present invention relates to a concrete building technique that solves the problems of prior approaches. The current system provides a concrete construction technique that is practical for single and multi-family units in cold climates where heating is a significant cost in building operation.

The present invention provides for a building system that uses the building components and tools currently used in the concrete and construction industry but puts them together in a way that results in a cost effective and energy efficient structure. In addition to cast in place foam insulation and plastic wall ties, the building system uses polymer concrete elements as thermal breaking structural elements.

The building system includes a unique scaffolding system that is stronger, easier to erect and usable by all trades as the exterior of the building is completed. The scaffold system allows for reduced cost to the building during construction and provides a practical method applicable to the ongoing building maintenance.

The system can eliminate all framing costs typically associated with construction. The system includes a cost effective coating system for the exterior of the structure.

DETAILED DESCRIPTION OF THE DEVICE

Figure 1:
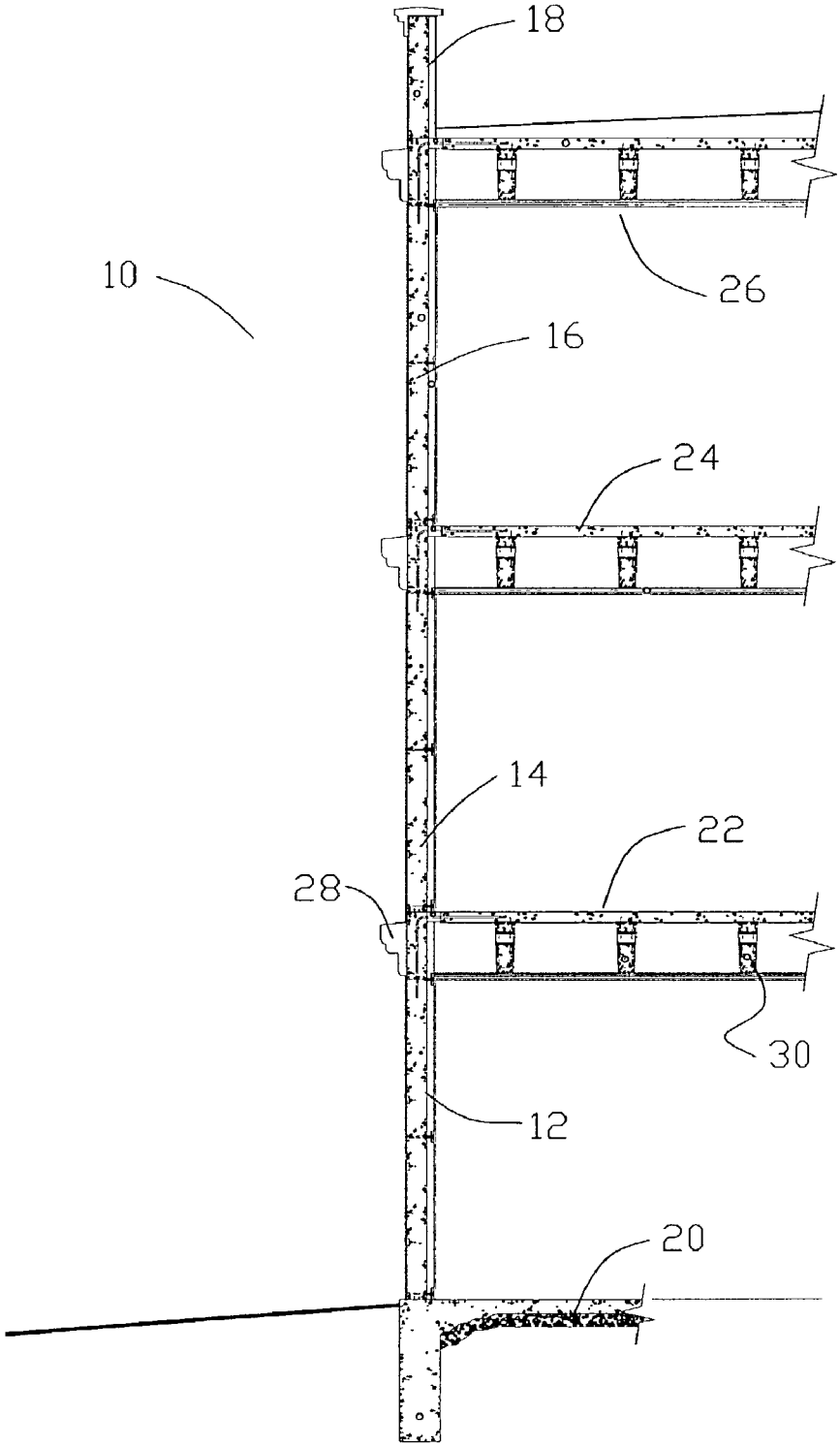
FIG. 1 shows a cross sectional view of a multi-story building using the system

FIG. 1 shows a partial cross sectional view of the building system (10). In this application there is a concrete wall composed of sections (12,14, and 16) each section defining a level of the building. A parapet wall (18) is formed at the top of the building. There is a first floor (20), two upper floors (22 and 24) and a roof (26). The exterior of the building includes a decorative molding (28) that is mounted on anchors (See FIG. 8) cast in the wall. In this view the concrete joists (30) are shown in cross section.

Figure 2:
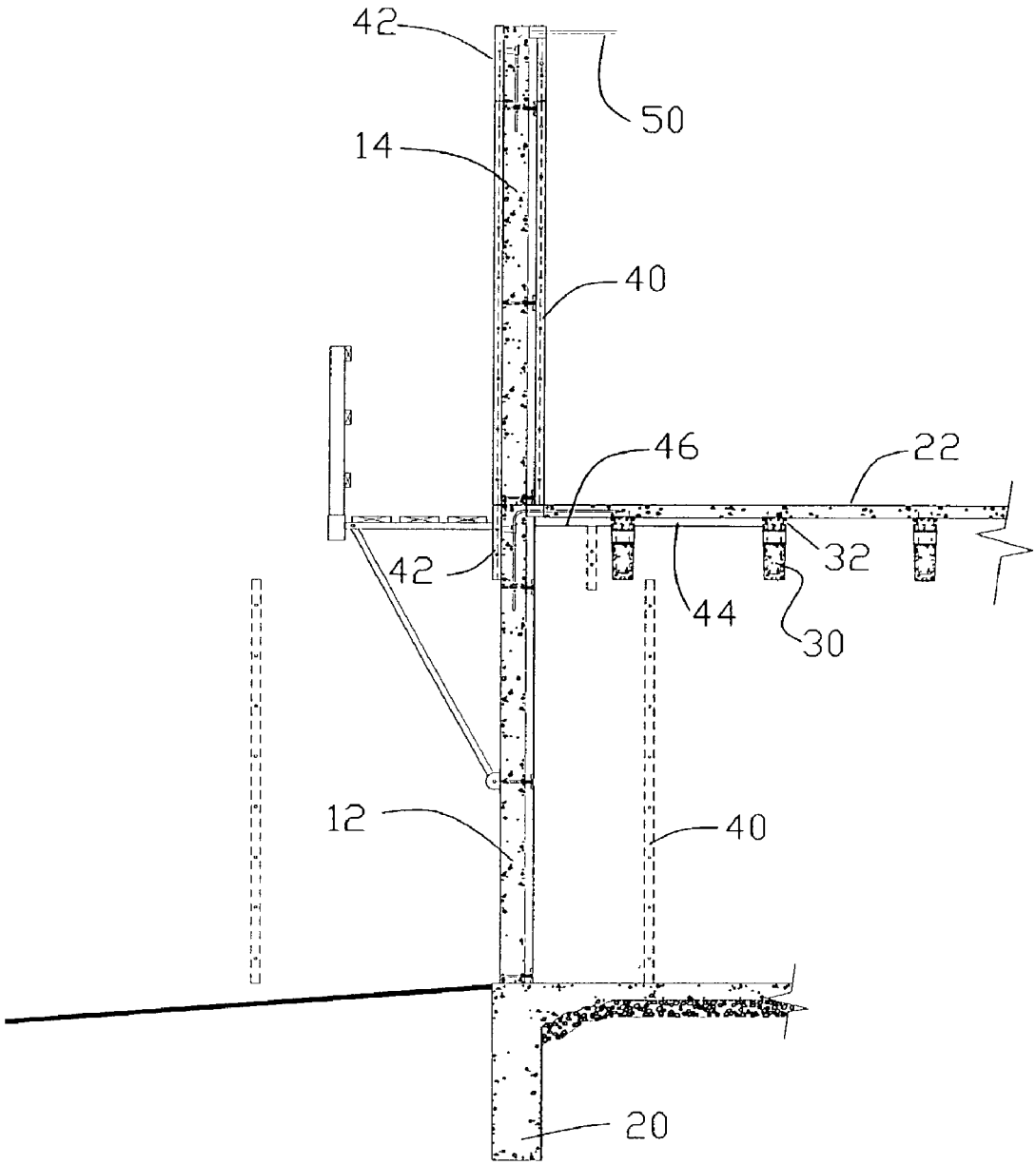
FIG. 2 shows a cross sectional view of the structure under construction

FIG. 2 shows some of the detail of the construction techniques. In FIG. 2 the first and second walls (12 and 14) as well as the first floor (20) and second floor (22) have been formed. Standard hand set aluminum concrete forms (40, 42 and 44 and 48) are shown. Each wall section requires 4 sets of forms two large forms (40) one on the inside and one on the outside, also one small cap form (42) set on top of the exterior form (40), and a slightly shorter cap form (48) on the inside form (40). Forms (44) are placed between the concrete floor joists (30) and the floor (22) is poured on top of them. A small groove (32) near the top of each joist (30) holds the forms in place. In FIG. 2 one form (44) is still in place, the others have been removed. In every building there will normally be at least one non-standard floor joist spacing requiring a non-standard floor form (46). Different size aluminum forms can be used in these non-standard spaces but often times a contractor will just use plywood. The groove (32) in the joist (30) will allow for the use of ¾" nominal plywood to be placed and then removed once the floor (22) is cured. The use of self supporting pre-cast joists (30) in this way eliminates the need for building a shoring structure as is commonly done now for concrete structures. At the top of the second wall (14) the fiberglass re-bar (50) that ties the floor and wall together at each level can be seen.

Figure 3:
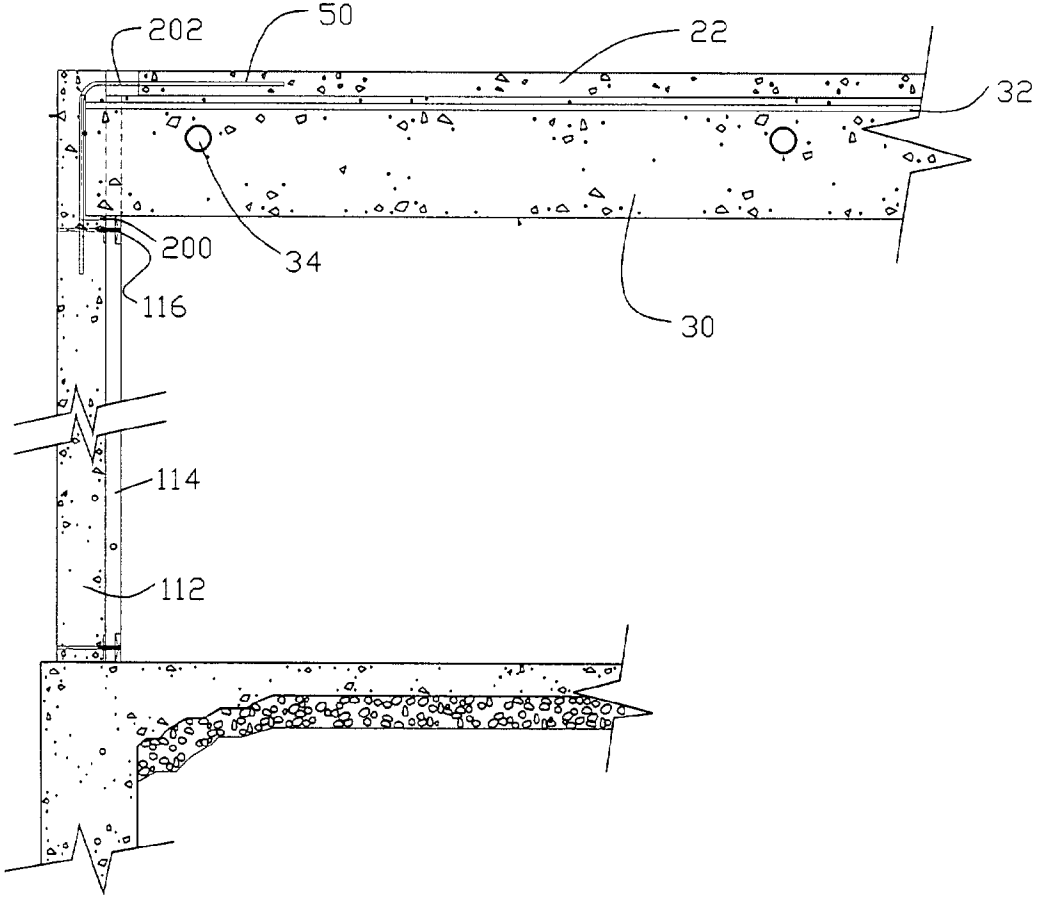
FIG. 3 shows detail on the load bearing wall, joist and floor

FIG. 3 shows detail on a joist support wall (112) and second floor (22). The wall includes rigid foam insulating panels (114) that are in the forms (40) (shown in FIG. 2) when the wall (112) is poured. This use of rigid foam as an insulator for concrete walls is fairly common in the industry with the fiberglass wall ties (116) being commercially available and used to hold the foam panels in place as the concrete is poured. The pre-cast joist (30) includes grooves (32) on each side of the joist. These grooves serve to hold the forms (44), shown in FIG. 2, that the floor (22) is poured on. The joist (30) also includes pre-formed holes (34) that allow for plumbing and electrical lines to be placed. The joist (30) sits on the load bearing wall (112) with a polymer concrete saddle block (200) in between. Polymer concrete is a mixture of polymers and aggregates that can be pre-cast into a variety of shapes. It forms a strong structural element capable of supporting significant compressive loads but it also has the property of not transferring much heat energy, the material has a low coefficient of heat transfer compared to concrete. So while the block (200) can support the load of the joist (30) it also isolates the joist (30) from transferring heat energy through the concrete exterior wall (112). The strip (202) is also of polymer concrete and runs along the perimeter of the floor (22). This block thermally isolates the bearing walls (112) and non-bearing walls from the floor (22) and again prevents the transfer of heat energy from the outside into the building or from the building to the outside.

Figure 4:
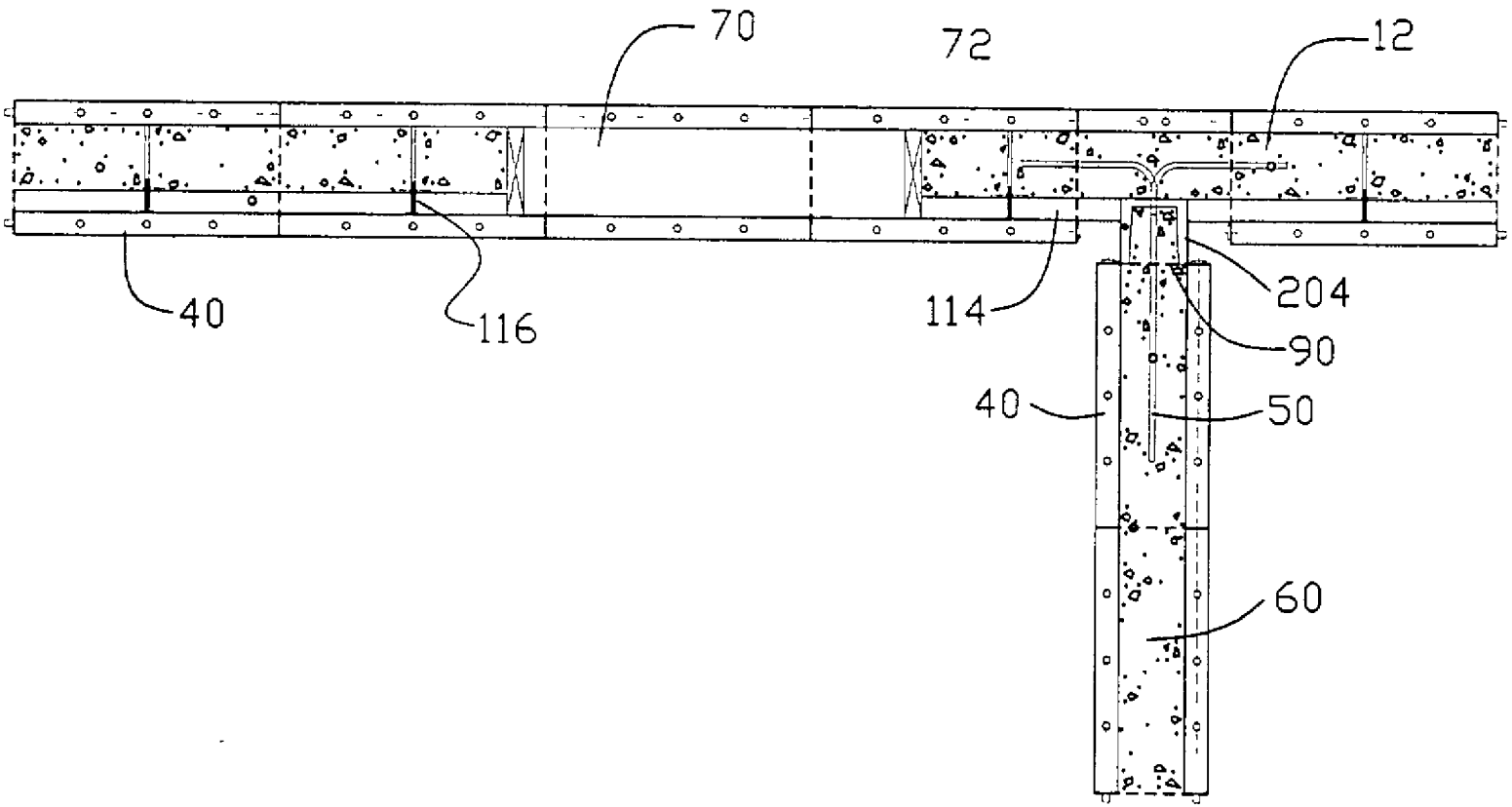
FIG. 4 shows a plan view of detail of the interior/exterior wall junction

FIG. 4 shows a typical forming plan for the junction between an insulated exterior wall (12) and a non-insulated interior wall (60). In this case the forms (40) are shown still in place. Rigid insulation (114) is placed in the forms and held out of the way of the pour by industry standard ties (116). An opening (70), such as a window, is formed by framing (72) of CCA treated lumber. A third type of polymer concrete block (204) is shown and forms the structural connection between the exterior wall (12) and the interior wall (60). Like the other polymer concrete blocks, the boot (204) forms a thermal break that prevents heat transfer from the exterior wall (12). Fiber reinforced plastic rebar (50) passes through the boot from the exterior to the interior wall and is tied to standard metal rebar (not shown) in the interior and exterior walls. This rebar (50) also resists heat transfer. During setting of the concrete forms (40) the boot is placed against standard metal ties (90) that are bolted to the end of the forms (40) to hold them together as the concrete is poured.

Figure 5:
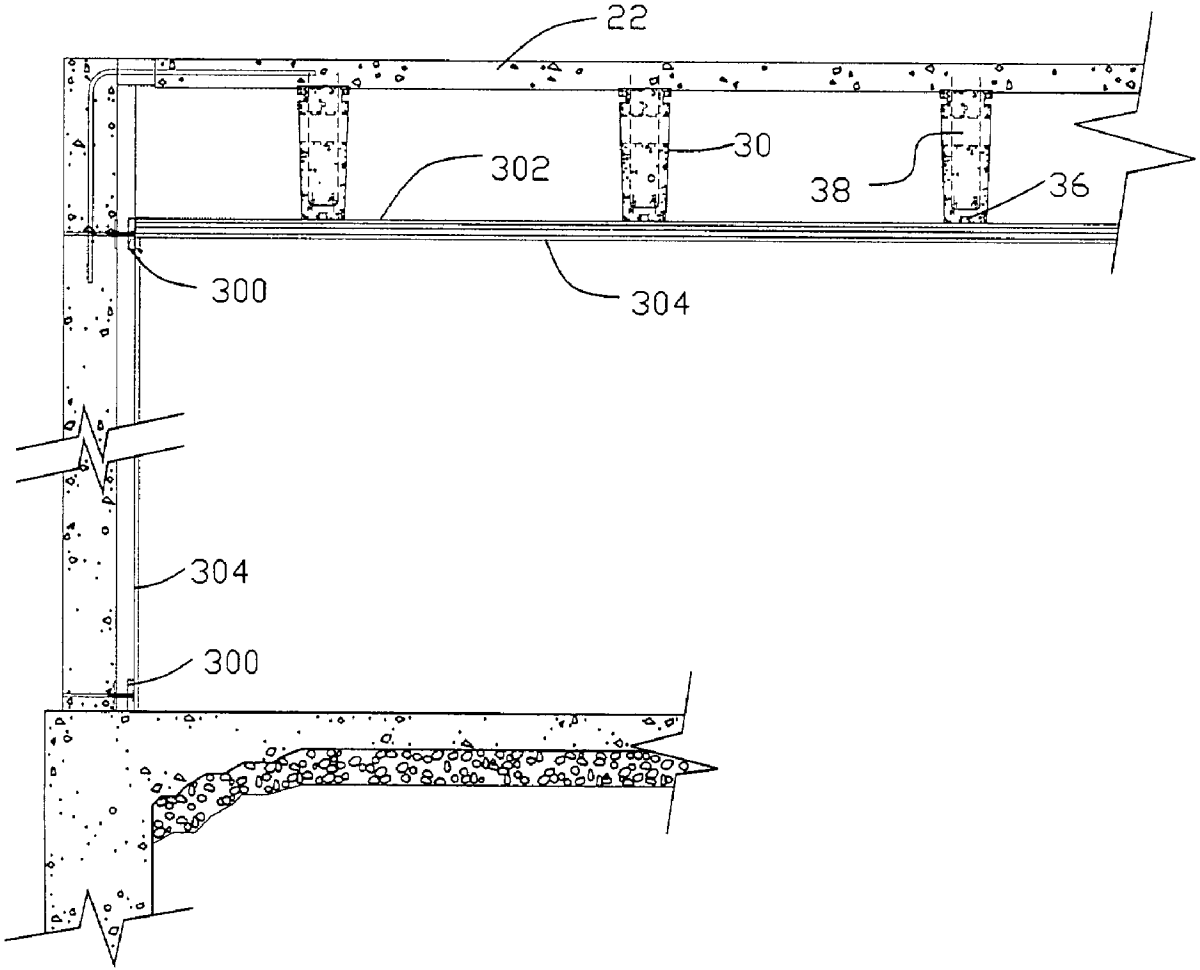
FIG. 5 shows detail on the non-load bearing wall

FIG. 5 shows some of the detail on finishing the interior and more detail on the joists (30). The joist (30) includes a cast in place light gage metal channel (36) for connectors. The channel can be filled with a material (wood, fiber, plastic) that will allow for the attachment of firing strips (302) that in turn allows for the attachment of sheet material such as drywall (304). The joist (30) includes a wire element (38) that is cast into the joist (30) when it is formed. The wire (38) extends above the top of the joist (30) and into the floor (22) and ties the two elements together after the floor (22) cures.

Figure 6:
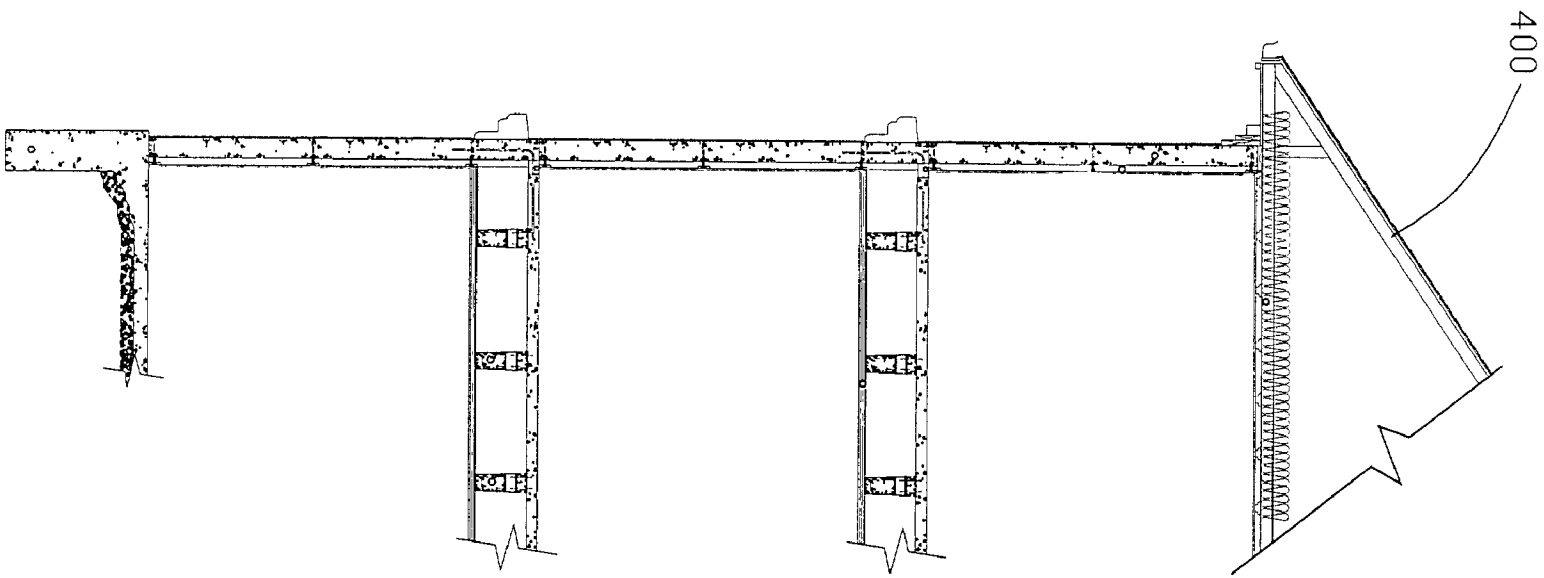
FIG. 6 shows the system with a wood roof structure

FIG. 6 shows an embodiment of the system where the roof (400) is a wood roof.

Figure 7:
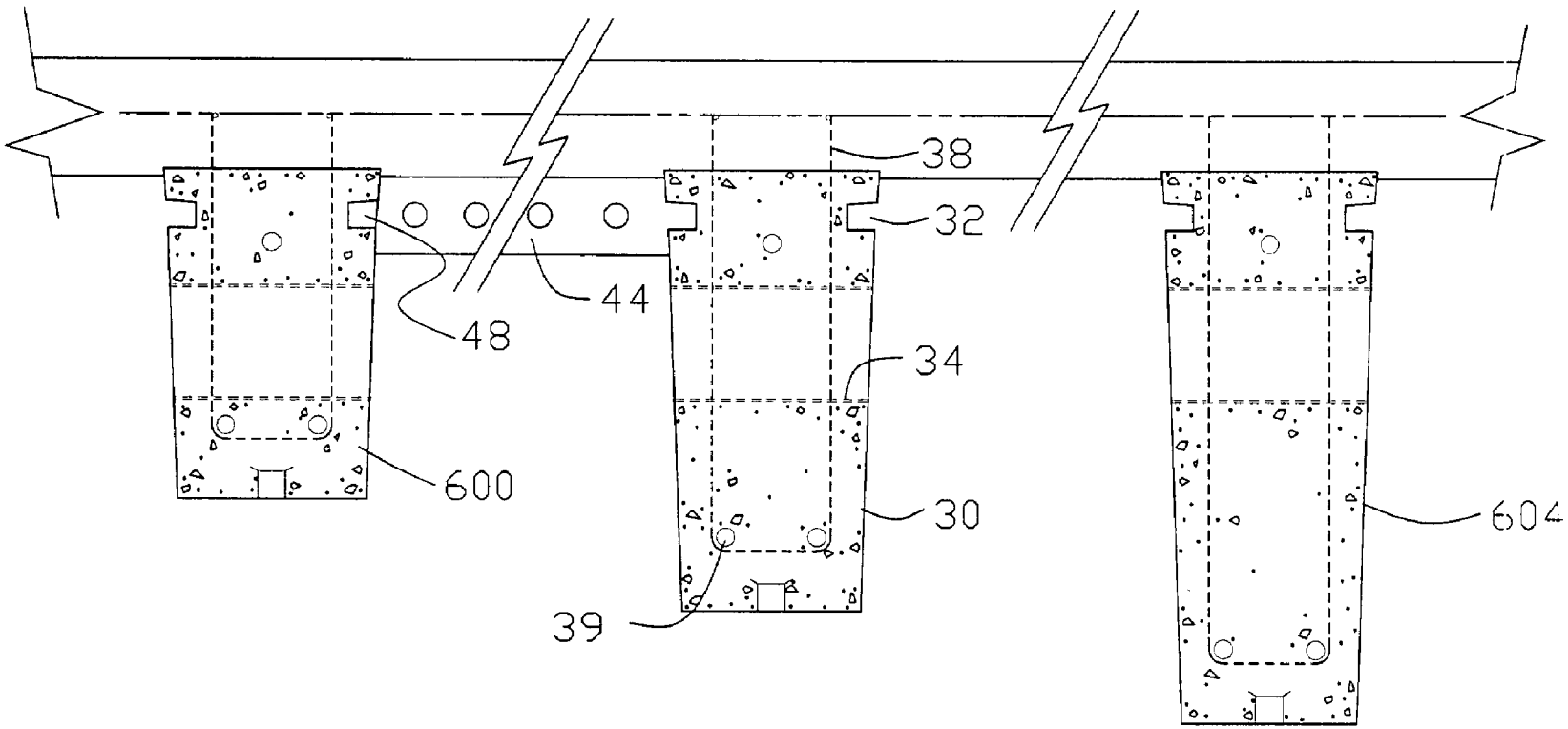
FIG. 7 shows various cross sections of different size joists for use in the system

FIG. 7 shows cross sectional views of floor joists for different load applications. The joists are cast in long beds. A shorter joist (600) can be formed by placing filler material in the form that does not become part of the joist. Similarly, a taller joist (604) can be formed by removing the filler material. Thus a variety of sizes of joists can be formed for various applications using the same basic form. The steel strands (39) that run the length of the joists are pre-stressed prior to casting the concrete. The steel strands (39) are stressed so that the resulting joist is flat. Once the concrete sets up it will hold the steel strands (39) in tension. Because the joists (30, 600 and 604) are concentrically stressed they can be cut in the field and still function properly, this gives the system practical flexibility that allows the construction crew to deal effectively with problems encountered during construction. FIG. 7 also shows that the standard forms (44) include tabs (48) that engage the slots (32) in each joist (30,600, and 604). Once a floor is cast the form (44) can be removed by operating a handle (not shown) that retracts the tabs (48) from the slots (32) releasing the form (44) from the joists.

Figure 8:
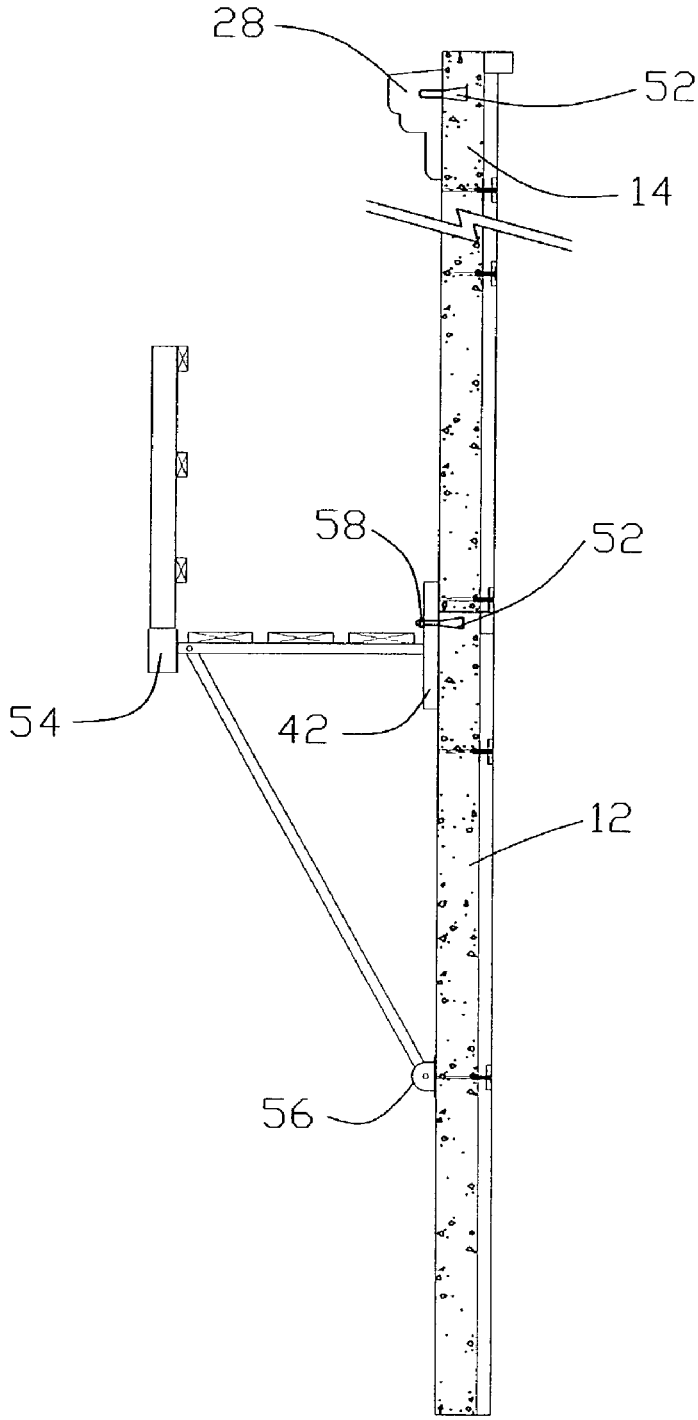
FIG. 8 shows details of the scaffold portion of the system

FIG. 8 Shows details of the scaffolding system that is part of the building system. Plastic anchors (52) are located in the wall sections (12,14) as they are being cast. The plastic anchor (52) includes a threaded hole or other attachment means that allow it to be used as an anchor. After the forms (40) (FIG. 2) are removed the small cap form (42) stays in place on the exterior wall. The next set of forms (40) are placed on top of it. Workmen assembling the next set of forms can use the scaffolding (54) to work from, they also use the scaffolding when the set of forms is ready to be taken down. Work proceeds up the side of the building in this manner for however many floors there are. Once at the top of the building workmen can also use the scaffolding to perform other tasks such as setting windows and painting the exterior of the building. Once the building is nearly complete the scaffolds are taken down and decorative moldings are placed over the anchor points (52). At later times when the building needs to be cleaned or repainted the molding (28) can be taken off and the anchor points reused. This offers the building superior performance both during construction and under maintenance.

Figure 9:
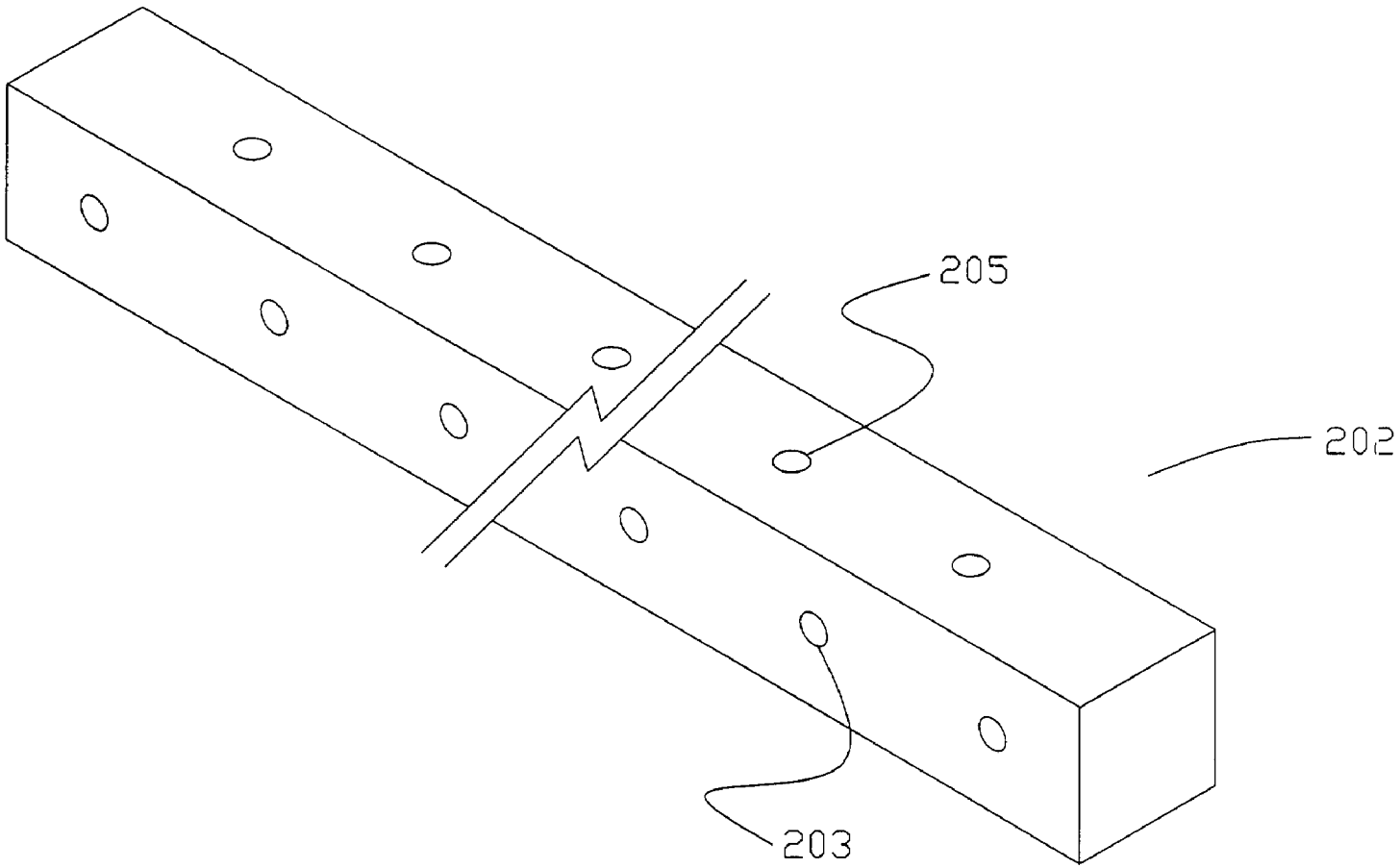
FIG. 9 shows details of a polymer concrete thermal structural transition block

Referring now to FIG. 9, the detail of polymer concrete block (202) are shown. The block is a long rectangular device. Regularly spaced holes (203) allow for fiber reinforced plastic ties to pass from the exterior wall into the floor. The block also includes regularly spaced holes (205) which allow the block to be tied into the standard form (40) as the wall is being cast.

Figure 10:
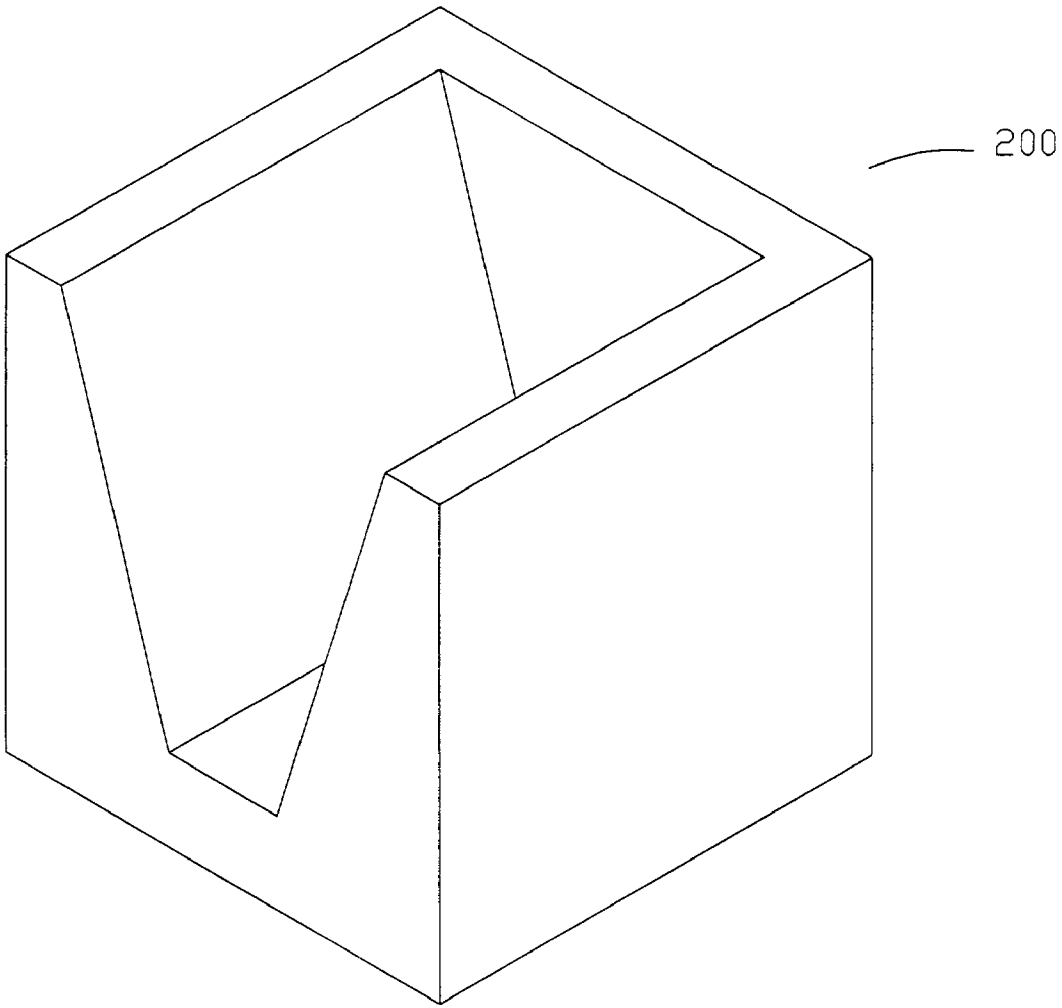
FIG. 10 shows details of a polymer concrete thermal structural transition joist pocket

FIG. 10 shows the polymer concrete pocket (200) designed to support and insulate the end of each joist (30). The interior shape of the pocket matches the profile of the joist.

Figure 11:
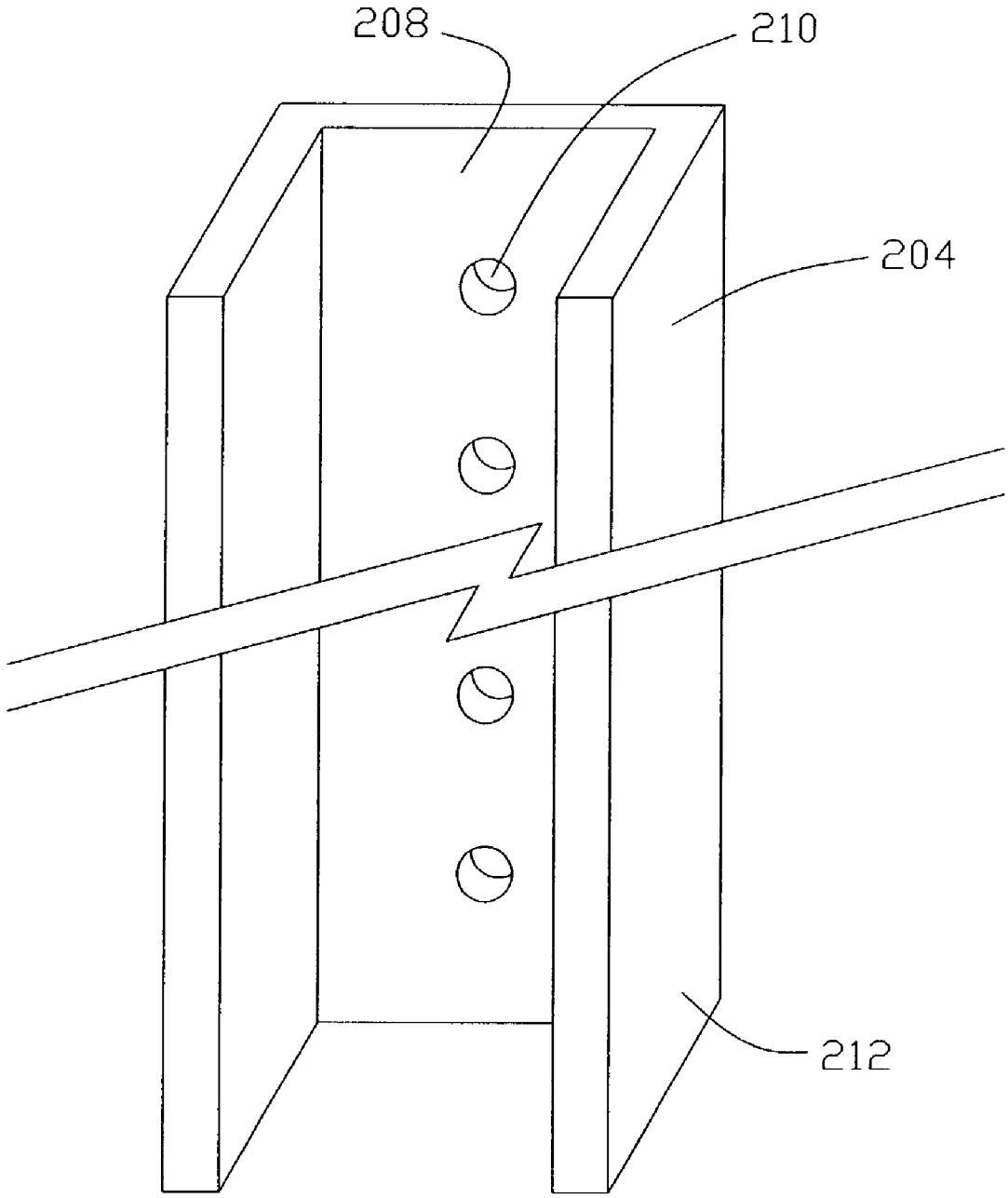
FIG. 11 shows details of a polymer concrete thermal structural transition boot

FIG. 11 details the boot (204) that insulates the connection between the exterior and interior wall (FIG. 4). The boot (204) includes a back wall (208) that rests against the exterior wall (12 in FIG. 4). The side-walls of the boot (212) rest against the forms (40 FIG. 4) for the interior wall. Holes (210) allow for placement of fiber reinforced plastic rebar (50). Each of the polymer concrete elements (202, 200 and 204) are formed in a molding operation using a mixture of concrete and epoxy resins.

Figure 12:
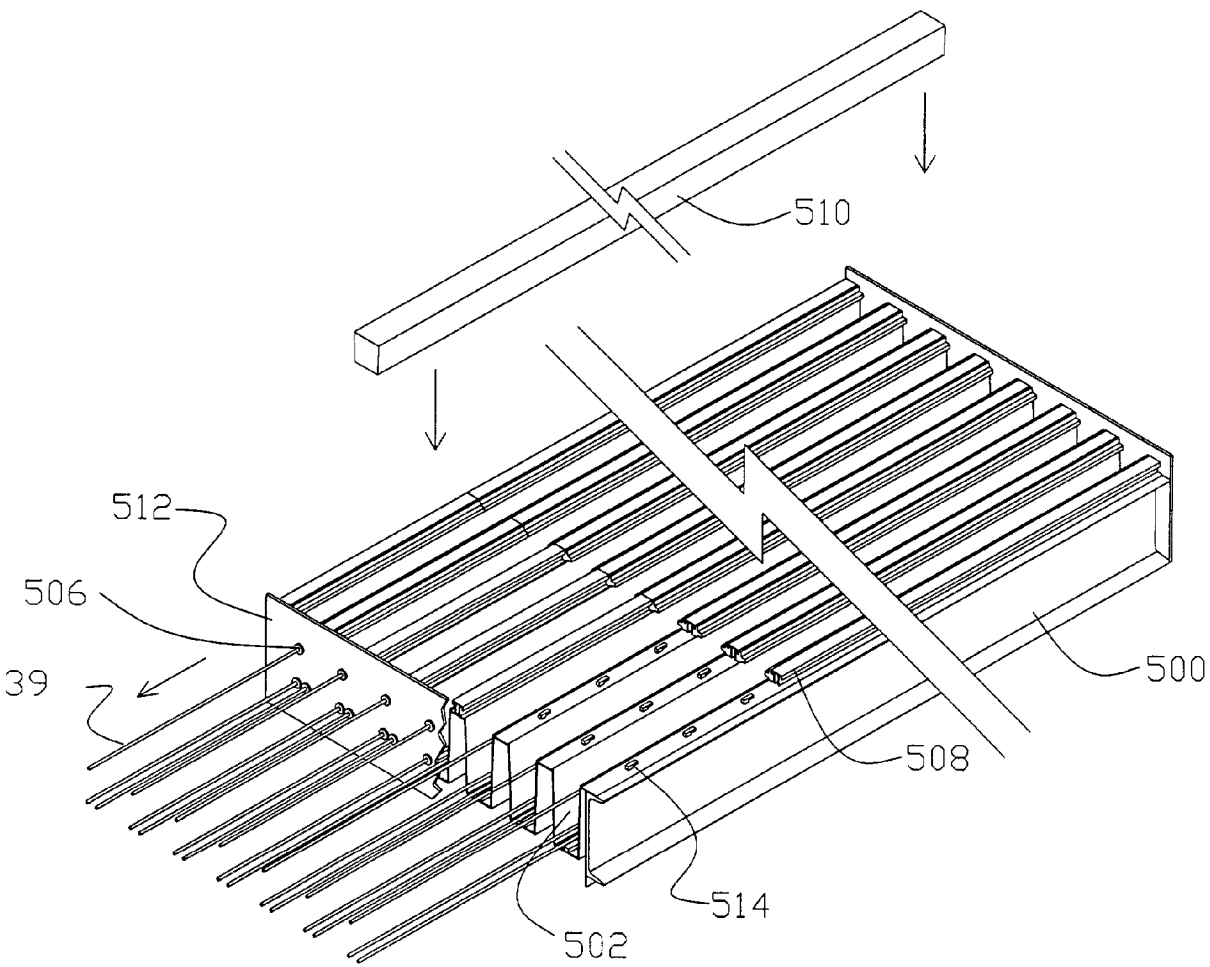
FIG. 12 shows details of the bed used to cast the pre-stressed joists

FIG. 12 shows some detail of the bed (500) used to form the pre-stressed joists (30). The bed includes a number of channels (502) in this case 7 channels will allow for 7 joists to be cast. Three steel wires (39) are stretched in each channel (502). For example a half inch diameter wire might be pre-stretched with a force of 270 kips by a hydraulic ram (not shown). Once the tensile member (39) is stretched a one way device (506), supported by end plate (512), will hold it in the tensile condition while all the other tensile members are stretched. End plates (512) and one way devices (506) are on each end of the bed. Once the tensile members are loaded, the concrete can be cast into each channel. Attachable plastic strips (508) can be used to create the groove (32, see FIG. 7) in each joist (30). The strips (508) are held on by hooks (514) and can be stripped of the bed as each solid joist (30) is removed. The element (510) can be placed in a channel (502) when it is desirable to form a joist of shorter profile as shown in FIG. 7. In this way a variety of joists can be formed using a single bed. The wire mesh (38) shown in FIG. 7, can be used to lift each joist out of the bed once it has set up.

The insulated concrete building system has been shown using standard tools available for building a cast in place concrete structure. The system can also be applied to tilt up concrete building system where the walls are cast horizontally and tilted up or hoisted into place.

The invention claimed is:

1. A concrete building system including;

a plurality of cast concrete joists, each of said joists including a length and a flat planar top surface;

each of said joists including a groove on each side thereof, said groove being parallel and adjacent to said top planar surface, said building system including two walls and a space between said walls, each of said cast concrete joists spanning said space and resting on each of said walls;

concrete forms sized to fit between two of said joists and means on each of said forms adapted to engage said groove to releaseably hold said concrete form in place between said joists, a concrete floor on top of said joists and forms such that the floor and the forms are supported on the two walls by the joists wherein the cast concrete joists include pre-tensioned reinforcement strands and wherein said means on each said form includes retractable tabs.

2. The concrete building system of claim 1, wherein the cast concrete joists are pre-stressed.

3. The concrete building system of claim 2, wherein each said concrete joists include a bottom surface and wherein said bottom surface includes a channel and where firing strips are attached to said joists using said channels.

4. A concrete building system including;

at least two pre-cast concrete joists, each of said concrete joists including a length, two side surfaces and a top surface;

at least one concrete form;

said building system including two structural elements and a space between the structural elements, each of said pre-cast concrete joists spanning said space and being supported by said structural elements;

grooves on the two side surfaces of each of said pre-cast concrete joist, said grooves adapted to releasably hold said at least one concrete form in place between said joists, a concrete surface poured on top of said joists and said at least one form such that the concrete surface is supported on the two structural elements by the joists and said form is releasably supported on the two concrete joists by tabs retractable from said groove after said surface is poured.

5. The concrete building system of claim 4, wherein said top surface includes wire projections on said top surface.

6. The concrete building system of claim 5, wherein each of said joists include a bottom surface and where firing strips are attached to said bottom surface using non-concrete material embedded in said bottom surface.

7. The concrete building system of claim 6, wherein said non-concrete material is wood.

8. A pre-cast concrete building joist for use in building systems having a cast in place concrete floor including;

a form;

said building joist having a length, two side surfaces, a bottom surface and a flat planar top surface;

said joist including a groove on each side surface thereof, said groove being parallel and adjacent to said top planar surface, and said groove adapted to receive said form used to cast said floor, said joist including pre-tensioned metal reinforcement bars along said length and a firing strip on said bottom surface and along said length and such that the floor is supported on the joists and the forms are releasably supported on the joists by retractable tabs engaging said groove.

* * * * *